US007600668B2

(12) United States Patent
Pham

(10) Patent No.: US 7,600,668 B2
(45) Date of Patent: Oct. 13, 2009

(54) AROMATIC FIBROUS STRIP FOR CONSUMER PACK

(75) Inventor: Xuan Pham, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 642 days.

(21) Appl. No.: 11/490,299

(22) Filed: Jul. 20, 2006

(65) Prior Publication Data

US 2007/0023301 A1 Feb. 1, 2007

Related U.S. Application Data

(60) Provisional application No. 60/702,754, filed on Jul. 27, 2005.

(51) Int. Cl.
*B65D 65/26* (2006.01)
*B65D 65/28* (2006.01)

(52) U.S. Cl. ..... 229/87.05; 428/43; 428/905

(58) Field of Classification Search ..... 229/87.05; 428/43, 905

See application file for complete search history.

(56) References Cited

U.S. PATENT DOCUMENTS

| | | | | | |
|---|---|---|---|---|---|
| 3,599,859 | A * | 8/1971 | Maierson | 206/216 |
| 4,105,144 | A * | 8/1978 | Lin | 222/187 |
| 4,528,226 | A * | 7/1985 | Sweeny | 428/40.2 |
| 4,717,017 | A | 1/1988 | Sprinkel, Jr. et al. | |
| 4,720,423 | A | 1/1988 | Fraser | |
| 4,817,860 | A * | 4/1989 | Shapiro | 229/80 |
| 5,175,142 | A * | 12/1992 | Dervieux et al. | 512/4 |
| 5,249,676 | A | 10/1993 | Ashcraft et al. | |
| 5,427,235 | A | 6/1995 | Powell et al. | |
| 5,542,529 | A | 8/1996 | Hein, III et al. | |
| 5,746,603 | A * | 5/1998 | Foster et al. | 434/219 |
| 5,938,018 | A * | 8/1999 | Keaveney et al. | 206/261 |
| 6,102,224 | A * | 8/2000 | Sun et al. | 215/252 |
| 6,612,429 | B2 * | 9/2003 | Dennen | 206/268 |
| 2006/0278542 | A1 * | 12/2006 | Pham et al. | 206/268 |
| 2007/0142795 | A1 * | 6/2007 | Cohen et al. | 604/359 |

FOREIGN PATENT DOCUMENTS

| | | | |
|---|---|---|---|
| GB | 2319511 | | 5/1998 |
| JP | 2008247460 | A * | 10/2008 |

* cited by examiner

*Primary Examiner*—Jes F Pascua
(74) *Attorney, Agent, or Firm*—Connolly Bove Lodge & Hutz LLP

(57) ABSTRACT

A consumer pack with flexible outerwrap around the pack has a tear tape between the pack and the outerwrap for separating the outerwrap into upper and lower portions when the consumer pack is opened. A multi-layer aromatic strip is positioned on an outer surface of the outerwrap just outside the tear tape, and the aromatic strip is secured thereto by an adhesive layer. The aromatic strip includes a fibrous substrate soaked with fragrance and an outer barrier surface that seals in the fragrance. When the tear tape separates the outerwrap into upper and lower portions, the outer barrier surface and the fibrous substrate are broken open to release fragrance to the surroundings.

4 Claims, 2 Drawing Sheets

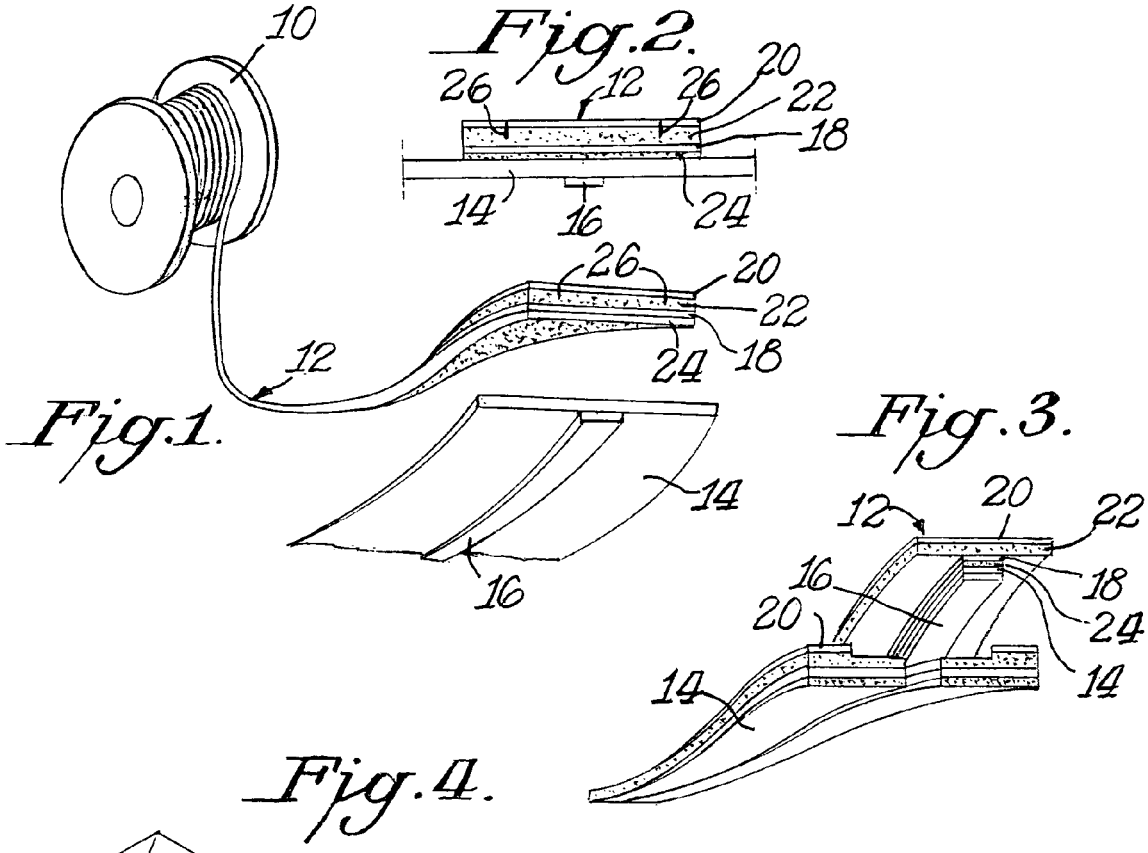
Fig.1.
Fig.2.
Fig.3.
Fig.4.
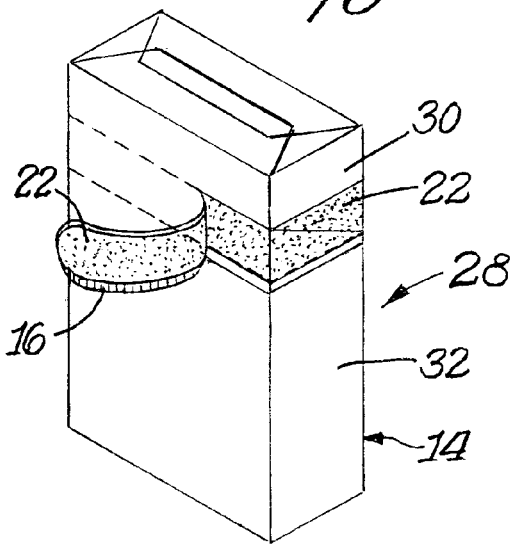

AROMATIC FIBROUS STRIP FOR CONSUMER PACK

CROSS REFERENCE RELATED TO APPLICATION

The present application claims the benefit of provisional application Ser. No. 60/702,754, filed Jul. 27, 2005, for all useful purposes, and the specification and drawings thereof are included herein by reference.

BACKGROUND OF THE INVENTION

Packaging for consumer packs such as cigarette packs is generally well known. A cigarette pack typically includes a foil layer wrapped around the cigarettes in the pack; paper or paperboard wrapped around the foil layer; and a layer of outerwrap, generally comprising a metallic film or a transparent film of a polymeric material such as polyethylene, wrapped and sealed around the entire pack to maintain cigarette freshness. A thin strip of material, generally consisting of a polymer such as polypropylene, is provided on the inner side of the film before the film is wrapped around the pack. This strip of material, called a "tear strip," is usually denser and stronger than the film and usually projects from the wrapping at a side of the pack and is pulled to slit open the polymeric wrapping thereby dividing the wrapping into upper and lower portions. The upper portion is usually removed and discarded to thereby gain access to the packaged cigarettes.

U.S. Pat. No. 4,717,017 to Sprinkel, Jr. et al. teaches the use of a receptacle that can be outside the polymeric film of a cigarette pack or between the film and the tear strip. The receptacle is filled with an aromatic substance. When the tear strip is pulled to slit the polymeric film, the receptacle is also slit open, releasing the substance contained therein for dispersal into the air or onto the cigarettes in the pack.

Currently, there is a need in the art to provide an aromatic substance to the surface of a package film by a continuous method. Furthermore, there is a need and desire to provide aromatic substances that release aroma when the tear strip is pulled along the package.

SUMMARY OF THE INVENTION

Accordingly, it is an object of the present invention to provide a consumer pack or other package that releases a fragrance upon opening. It is also an object of the invention to provide an aromatic fibrous strip which can be applied on the outerwrap of a consumer pack, such as a cigarette pack, and which can be easily opened by a tear-strip on the pack.

In accordance with the present invention, a consumer pack with flexible outerwrap around the pack has a tear tape between the pack and the outerwrap for separating the outerwrap into upper and lower portions when the consumer pack is opened. A multi-layer aromatic strip is positioned on the outer surface of the outerwrap just outside the tear tape, and the aromatic strip is secured thereto by an adhesive layer. The aromatic strip includes a fibrous substrate soaked with fragrance and an outer barrier surface that seals in the fragrance. When the tear tape separates the outerwrap into upper and lower portions, the outer barrier surface and fibrous substrate are broken open to release fragrance to the surroundings.

The aromatic fibrous substrate may include score lines to assist in breaking open the barrier surface and fibrous substrate when the pack is opened. Moreover, the aromatic strip may also include a base layer which may be printed under the fibrous substrate, and the base layer may be secured to the outerwrap by the adhesive layer.

Preferably, the aromatic strip is positioned on the outer surface of the outerwrap so that all of the aromatic strip remains with the upper portion of the outerwrap when the consumer pack is opened. All of the fragrance is removed when the upper portion of the outerwrap is discarded.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which:

FIG. 1 is a perspective view of a multi-layer fibrous aromatic strip on a bobbin for application to the outerwrap of a consumer pack, according to the present invention;

FIG. 2 is an end elevational view of the multi-layer fibrous aromatic strip of FIG. 1 applied to the outerwrap with a tear tape under the wrap, according to the present invention;

FIG. 3 is a perspective view illustrating the tear tape separating the outerwrap and breaking open the fibrous aromatic strip to release fragrance upon opening the pack;

FIG. 4 is a perspective view of a hinge lid cigarette pack with a multi-layer aromatic strip secured thereto, according to the present invention.

DETAILED DESCRIPTION OF A PREFERRED EMBODIMENT

Figure 5:
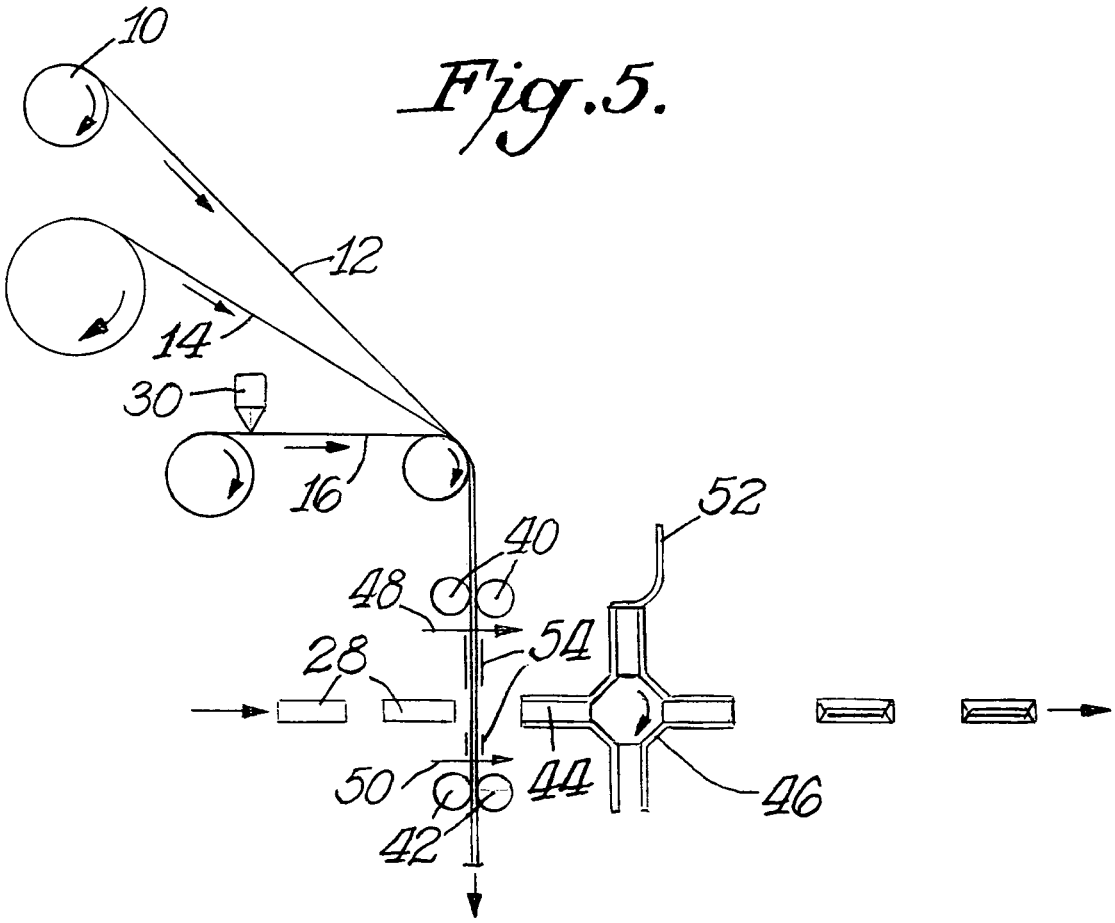
FIG. 5 is a schematic view showing one method for applying outerwrap with a multi-layer fibrous aromatic strip to a consumer pack.

Referring with more particularity to the drawings, FIG. 1 shows a bobbin 10 of a continuous multi-layer fibrous aromatic strip 12 for application to the outside surface of flexible outerwrap material 14 which includes a tear tape 16 inside the wrap. As shown in FIGS. 1-3, the multi-layer fibrous aromatic strip 12 includes a base layer 18 and an outside barrier coated surface 20 with a fibrous substrate 22 positioned therebetween. The fibrous substrate is pre-soaked with a liquid fragrance. As explained more fully below, the multi-layer fibrous aromatic strip 12 is secured to outerwrap 14 by an aggressive adhesive layer 24.

As diagrammatically illustrated in FIG. 3, when the tear tape 16 is pulled to separate the outerwrap material 14, the tape breaks open the fibrous substrate 22 and the outside barrier 20 to thereby release the fragrance within the substrate to the surroundings. The fibrous substrate may include score lines 26 therein to assist in breaking open the substrate and outside barrier when the tear tape 16 is manipulated to separate the outerwrap material 14. As shown in FIG. 2, the score lines 26 may extend into the fiber substrate approximately half way through the thickness of the substrate. This enables the substrate to separate at the score lines and also to transversely break apart along a line between the score lines 26.

FIG. 4 shows a hinge lid cigarette box 28 with flexible outerwrap material 14 around the box. As is well known, the tear tape 16 is positioned on the inside of the outerwrap and pulling the tear tape upon opening the cigarette box slits and separates the outerwrap material into upper and lower portions, 30 and 32, respectively. The multi-layer fibrous aromatic strip 12 is secured to the flexible outerwrap material 14 by the adhesive layer 24. The fibrous strip is positioned on the outside of the outerwrap material so that the tear tape is at the lower boundary of the aromatic strip. Accordingly, when the cigarette box is opened by manipulating the tear tape, the outerwrap material is separated into the upper and lower portions 30, 32, and all of the fibrous substrate 22 remaining with the outerwrap material remains with the upper portion 30. Accordingly, when the separated upper portion 30 of the outerwrap material 14 is removed and discarded all of the substrate 22 is removed and none of the fragrance soaked fibrous substrate remains with the cigarette box 28.

When the tear tape 16 is pulled upon opening the cigarette box 28, an immediate burst of fragrance is released, but when the upper portion 30 of the outerwrap material 14 is ultimately removed none of the fragrance soaked substrate remains. Hence none of the fragrance migrates to the user when the cigarette box is closed and stored next to the clothing of the user, for example.

FIG. 5 is a schematic view illustrating a continuous roll of the multi-layer fibrous aromatic strip 12 being secured to flexible outerwrap material 14 with the tear tape 16 being secured by glue 38 to the inner surface of the outerwrap material. The thus formed composite is then transported by roller pairs 40, 42 to a packaging station where individual consumer packs such as cigarette boxes 28 are wrapped with the outerwrap material 14 and the aromatic strip 12. The packs are urged to the right in FIG. 5 and pushed into open compartments 44 on a rotational turret 46. A given length of the composite material sufficient to overwrap each cigarette pack is cut from the continuous stream of composite material by upper and lower cutters 48, 50. As the turret rotates, a folding plate 52 seals the outerwrap material 14 around the cigarette pack. The upper roller pair 40 continues to transport the composite through guides 54 and the process is repeated.

What is claimed is:

1. A consumer pack with flexible outerwrap around the pack, a tear tape between the pack and the outerwrap for separating the outerwrap into upper and lower portions when the consumer pack is opened, and a multi-layer aromatic strip on an outer surface of the outerwrap secured thereto by an adhesive layer and positioned just outside the tear tape, the aromatic strip including a fibrous substrate soaked with fragrance and an outer barrier surface whereby when the tear tape separates the outerwrap into upper and lower portions the outer barrier surface and fibrous substrate are broken open to release fragrance.

2. A consumer pack as in claim 1 wherein the fibrous substrate includes score lines to assist in breaking open the barrier surface and fibrous substrate when the pack is opened.

3. A consumer pack as in claim 1 wherein the aromatic strip also includes a base layer under the fibrous substrate, and wherein the base layer is secured to the outerwrap by the adhesive layer.

4. A consumer pack as in claim 1 wherein the aromatic strip is positioned on the outer surface of the outerwrap so that all of the aromatic strip remains with the upper portion of the outerwrap when the consumer pack is opened.

* * * * *